US005507977A

United States Patent [19]

Virtanen et al.

[11] Patent Number: 5,507,977

[45] Date of Patent: Apr. 16, 1996

[54] CONDUCTING PLASTIC MATERIAL AND METHOD OF PRODUCING SUCH MATERIAL

[75] Inventors: Esa Virtanen, Porvoo; Kimmo Väkiparta, Helsinki, both of Finland

[73] Assignee: Neste Oy, Espoo, Finland

[21] Appl. No.: 386,866

[22] Filed: Feb. 10, 1995

[30] Foreign Application Priority Data

Feb. 10, 1994 [FI] Finland ..... 940626

[51] Int. Cl.[6] ..... H01B 1/00

[52] U.S. Cl. ..... 252/500; 252/518; 252/521; 528/422; 528/490; 524/425; 524/399; 524/432

[58] Field of Search ..... 252/500, 521, 252/518; 528/422, 488, 490

[56] References Cited

U.S. PATENT DOCUMENTS

| | | | |
|---|---|---|---|
| 3,963,498 | 6/1976 | Trevoy | 252/500 |
| 4,025,463 | 5/1977 | Trevoy | 252/500 |
| 4,983,322 | 1/1991 | Elsenbaumer | 252/500 |
| 5,232,631 | 8/1993 | Cao et al. | 252/500 |
| 5,340,499 | 8/1994 | Karna et al. | 528/422 |
| 5,346,649 | 9/1994 | Karna et al. | 252/500 |

FOREIGN PATENT DOCUMENTS 89775 7/1993 Finland .

OTHER PUBLICATIONS

Yong Cao et al., Influence of chemical polymerization . . . , Polymer, vol. 30 pp. 2305–2311, Dec. 1989.

*Primary Examiner*—Tae Yoon
*Attorney, Agent, or Firm*—Birch, Stewart, Kolasch & Birch

[57] ABSTRACT

The present invention is directed to electrically conducting complexes, methods of producing them, and their use in producing plastic materials with high electrical conductivity. The invention is particularly directed to an electrically conducting complex formed of two components, the total dissolution of which is avoided. The complex according to the invention has a more highly conductive component (A) and a component (B), which is capable of dissolving component (A). In a complex according to the invention, component (A) and component (B) are combined in such a way that limited dissolution takes place at the interface between the two, whereby the advantages of both components are obtained in the complex. The invention also concerns a method of producing the complex and use of the complex together with a polymer matrix to form plastic materials having high electrical conductivity.

22 Claims, No Drawings

CONDUCTING PLASTIC MATERIAL AND METHOD OF PRODUCING SUCH MATERIAL

BACKGROUND OF THE INVENTION

1. Field of the Invention

The present invention concerns electrically conducting complexes, methods of producing such complexes and their use in producing highly conducting plastic materials. More particularly, the present invention concerns such a complex which comprises two components, the complete dissolution of which must be avoided.

In the complex according to the present invention, there is a highly conductive component (component (A)) and a second component (component (B)), which is capable of dissolving component (A). In the present invention, component (A) and component (B) are combined so that limited dissolution takes place at the interfaces between the parts, whereby the advantages of each component are obtained in the complex. The invention also concerns a method of producing the complex and the use of such complexes together with a polymer matrix in highly conductive plastic materials.

2. Description of the Related Art

Currently, electrically conducting polymers are attracting great interest worldwide. Such polymers offer the possibility of replacing metallic conductors and semiconducting materials in a plurality of applications including batteries, sensors, switches, photocells, circuit boards, heating elements, antistatic protection (ESD) and electromagnetic interference protection (EMI). Conducting polymers have the advantages over metals of light weight, corrosion resistance, and lower production and processing costs.

Conducting polymers can be roughly categorized into two different groups: filled conducting polymers, which contain a conductive filler, e.g. carbon black or lampblack, carbon fiber, metal powder, etc., added to a thermosetting or thermoplastic resin; and intrinsically conducting polymers and complexes, which are based on polymers made conductive by an oxidation, reduction or protonation (doping) process.

The electrical conductivity of filled conducting polymers is dependent on the mutual contacts formed between the conductive filler particles. Typically, approximately 10 to 50% by weight of well-dispersed filler material is required to achieve composites of high conductance. However, problems are associated with such conducting composite materials: the mechanical and other properties of such composites are decisively degraded as the filler content increases and the polymer content decreases; their conductivity becomes difficult to control particularly in the semiconductor range; and stable and homogeneous dispersing of the filler into the matrix polymer becomes difficult.

Intrinsically conducting polymers can be produced from organic polymers having long chains formed by conjugated double bonds and heteroatoms. The polymers may be made into conductive complexes by modifying the $\pi$- and $\pi$-p electron systems of the double bonds and heteroatoms in the polymers by adding into the polymer certain doping agents. Thus, the backbone chain of the polymer can be modified to contain electron holes and/or excess electrons that provide pathways for the electric current along the conjugated chain.

The benefits of intrinsically conducting polymers and complexes include easy modification of their conductivity as a function of the dopant concentration, also described as the doping level, which is particularly accentuated in conjunction with low conductivities. By contrast, attaining low conductivities with filled conducting polymers is difficult. Examples of kinds of polymers known in the art as intrinsically conducting polymers include polyacetylene, poly-p-phenylene, polypyrrole, polythiophene and its derivatives and polyaniline and its derivatives.

Plastics are processed into desired articles, such as workpieces, fibers, films, etc., by two major types of processes: melt processing and solution processing. Melt processing is suitable for multiple applications, while solution processing can be used principally only in the manufacture of fibers and films, and is not generally suitable for making shaped articles. However, the processing and doping of most intrinsically conducting polymers result in problems with the handling, stability, homogeneity and other aspects of these materials when processed into conducting plastics.

An intrinsically conducting polymer that is particularly technically and commercially promising is polyaniline and its derivatives. Polyaniline is an aniline polymer or its derivative which is based on aniline monomers or their derivatives, in which the nitrogen atom is bonded to the para-carbon in the benzene ring of the next unit. Polyaniline can occur in several forms, such as leucoemeraldine, protoemeraldine, emeraldine, nigraniline and toluoprotoemeraldine. For conducting polymer applications, the emeraldine form, having the formula

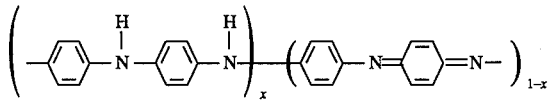

wherein x is approximately 0.5, is usually used.

Doping of polyaniline is performed in accordance with methods known in the art by conventionally using protonic acids including among others HCl, $H_2SO_4$, $HNO_3$, $HClO_4$, $HBF_4$, $HPF_6$, HF, acids of phosphorus, sulfonic acids, picric acid, n-nitrobenzoic acid, dichloroacetic acid and polymeric acids. Doping is advantageously performed with a sulfonic acid and most advantageously with dodecylbenzene sulfonic acid (DBSA). Protonation attacks the nonprotonated nitrogen atoms of the aniline units shown in the formula above, the proportion of such nonprotonated nitrogen atoms being approximately 50% of all N-atoms of the emeraldine base form of polyaniline. Herein reference is made to U.S. Pat. Nos. 3,963,498, 4,025,463 and 4,983,322, which are representative examples of the publications in the art. Numerous references to the forming of conductive complexes by doping of polyaniline with protonic acids may also be found in other literature in the art.

Conductive complexes of polyanilines doped with a protonic acid have been found extremely useful when blended with an excess amount of the protonic acid such as the above-mentioned sulfonic acid or its derivative, whereby the blend contains a sufficient amount of acid for both the doping and plasticization of the blend. In fact, using excess amounts of the protonic acid in this manner makes the doped polyaniline complex suitable for melt-processing, as the protonic acid serves the above two functions in the blended compound. However, such use of excess protonic acid gives doped polyaniline an acidic pH value, which acidity may decidedly hamper the use of the conducting polymer in most applications.

U.S. Pat. No. 5,340,499, which is incorporated by reference, discloses a method of plasticizing a conducting polymer complex containing polyaniline doped with a protonic acid, advantageously a sulfonic acid and most advantageously dodecylbenzene sulfonic acid. In the method according to the cited publication, the polymer blend containing doped polyaniline is treated with a metallic compound. According to the preferred embodiment of the method, the compound suited for plasticizing the doped polyaniline is prepared by reacting a metallic compound, most advantageously zinc oxide, with any acid capable of forming, with the metallic compound, a compound that acts as a plasticizer for the doped polyaniline. Such an acid is advantageously the same acid as that used for doping, namely, dodecylbenzene sulfonic acid (DBSA). The reaction mixture is heated and the plasticizing metallic compound thus formed is dried, cooled, and milled prior to being blended with the doped polyaniline. To transform the doped polyaniline into a processable form, the solidification method based on heat treatment disclosed in U.S. Pat. No. 5,346,649, which is incorporated herein by reference, is used.

Accordingly, the above-described method provides, most advantageously using a ZnO/DBSA compound, a less acidic, electrically conducting polyaniline plastic, which is further blended with a suitable matrix polymer such as polyethylene, to achieve the required mechanical properties. Thus, the zinc compound acts in this kind of blend as a plasticity and/or compatibility improving agent between the conducting polymer and the matrix polymer.

SUMMARY OF THE INVENTION

It is an object of the present invention to achieve a plastic material of high electrical conductivity, which is suitable for a variety of applications.

It is also an object of the present invention to obtain an electrically conducting complex that is highly conductive and also very plasticizable.

It is a further object of the present invention to obtain a highly conductive, very plasticizable electrically conducting complex that minimizes or avoids the handling, stability, and homogeneity problems associated with prior art conductive materials, and which can be processed using conventional processing equipment and processes.

It is a further object of the present invention to obtain an electrically conducting complex that can be incorporated into an insulating polymer matrix material, such as a thermosetting resin, a thermoplastic resin, or an elastomeric polymer by conventional polymer processing techniques, such as melt processing or solution processing techniques, in order to form a conducting plastic.

These and other objects and advantages are obtained by providing an electrically conducting complex, comprising:

(A) a first component comprising a conductive polymer, and (B) a second component comprising a material capable of dissolving said first component (A), wherein said first component (A) and said second component (B) have not totally dissolved in each other.

The objects and advantages of the present invention are also obtained by providing a method of producing the electrically conducting complex above, comprising contacting (A) a first component comprising a conductive polymer, with (B) a second component comprising a material capable of dissolving said conductive polymer in said first component (A), in such a way that said first component (A) and said second component (B) do not totally dissolve in each other, but that limited dissolution takes place at an interface between component (A) and component (B).

In both the electrically conducting complex and the method described above, the second component (B) may comprise a polymer that is less conductive and more plasticizable than said conductive polymer of component (A).

The objects and advantages of the present invention are also achieved by providing a plastic material having high electrical conductivity, comprising the electrically conducting complex above and a polymer matrix.

In other words, the objects and advantages of the present invention are obtained by a plastic material which contains an electrically conducting complex in accordance with the invention, which comprises two components, whose complete dissolution into one another is avoided. The electrically conducting complex according to the invention has a highly conducting part, component (A) and another part, component (B), which is capable of dissolving component (A). In the electrically conducting complex according to the invention, component (A) and component (B) are combined so that only limited dissolution may take place at the interface between the two, whereby the advantages of each component are both obtained in the electrically conducting complex. The electrically conducting complex according to the invention differs from existing basic complexes in that complete dissolution of components (A) and (B) is avoided.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

In the description below, the term "conductive polymer" refers to an undoped, intrinsically conductive polymer, or to a filled conductive polymer. The term "conductive polymer complex" refers to an intrinsically conductive polymer and a dopant. The term "electrically conducting complex" refers to the complex formed by combining component (A) with component (B), optionally with other components, such as plasticizers, etc. The terms "conducting plastic" or "plastic" refer to the combination of the electrically conducting complex with a matrix polymer.

The present invention is based in part upon the surprising and unexpected result that when complete dissolution of components (A) and (B) is avoided, the advantages of the components are combined synergistically. This result is new and surprising in view of the teachings in the related art.

In one embodiment of the electrically conducting complex according to the present invention, component (A) of the complex is preferably a conductive polymer complex comprising a conductive polymer doped with a protonic acid, sufficient to provide the electrically conducting complex, and the resulting conducting plastic product which includes the electrically conducting complex, with a high electrical conductivity. Component (B) may also be a polymer, but in this case is less conductive and more plasticizable than the conductive polymer of component (A).

In one embodiment of the present invention, it is advantageous to use as the doped conductive polymer (i.e., the conductive polymer complex) a polyaniline which is doped with a functionalized protonic acid solute as defined in U.S. Pat. No. 5,232,631, which is hereby incorporated by reference, in such a way that both melt-processability and solution-processability of the doped conductive polymer (i.e., the conductive polymer complex) are achieved. Dodecylbenzene sulfonic acid is a very advantageous functionalized protonic acid solute for doping polyaniline. However, other conductive polymers and dopants may be used, provided that the requirements of incomplete dissolution of the components of the electrically conducting complex, discussed above, are met.

In one embodiment of the method according to the present invention, one or both of component (A) and component (B) are intrinsically conductive polymers, such as conductive polymer complexes. This results in significant advantages compared with the polymer dispersions disclosed in the related art, which are made conductive by filling with electrically conducting metal particles or other such particles. However, components (A) and (B) need not be intrinsically conductive polymers or conductive polymer complexes for the present invention to be operable.

In a particular embodiment of the present invention, component (B) of the electrically conducting complex according to the present invention is the same conductive polymer as is in component (A), and when component (A) is a conductive polymer complex, then component (B) may be the same conductive polymer complex as in component (A) (i.e., doped with the same functionalized protonic acid solute), but component (B) is plasticized by adding a suitable plasticizing agent that does not destroy the conductivity of the conductive polymer or conductive polymer complex. However, component (B) need not contain the same conductive polymer or conductive polymer complex as component (A) for the invention to be operable.

When component (A) is a polyaniline which is doped with a functionalized protonic acid, such as dodecylbenzene sulfonic acid, it is advantageous that component (B) of the electrically conducting complex comprise a polyaniline doped with the same functionalized protonic acid and also contain a reaction product of the plasticizing protonic acid and a metal compound.

Component (A) of the electrically conducting complex is usually more acidic than component (B), and it is preferable for component (B) to have a composition such that the electrically conducting complex obtained by combining the components is essentially neutral, and is thus suitable for processing by different processing machines and for a variety of applications.

The properties of the electrically conducting complex are especially good when component (B) comprises a polyaniline doped with dodecylbenzene sulfonic acid and a reaction product of dodecylbenzene sulfonic acid and a zinc compound, produced in accordance with U.S. Pat. No. 5,340,499. The conductivity and processability of the electrically conducting complex and of the conducting plastic products produced therefrom are thereby very much improved over compositions of the prior art. When the electrically conducting complex contains a reaction product of DBSA and a zinc compound, the quantity of acid for doping the polyaniline can be reduced, which results in a less acidic electrically conducting complex.

In another embodiment of the invention, the reaction product of a protonic acid and a metal compound may be used alone as component (B), and plasticizes the conductive polymer complex of component (A). For instance, when component (A) is a polyaniline doped with dodecylbenzene sulfonic acid, component (B) in the electrically conducting complex may be a reaction product of dodecylbenzene sulfonic acid and a metal compound, preferably zinc oxide, which brings about partial dissolution of component (A) and component (B) in accordance with the invention.

In another embodiment of the invention, a calcium compound, preferably calcium carbonate, may also be added to the electrically conducting complex according to the invention without significantly impairing its electrical conductivity or other properties. It is thereby possible to obtain an electrically conducting complex which is essentially neutral. For purposes of this invention, a plastic or polymer or polymer complex is essentially neutral when it has a pH value in the range 3–8, preferably a pH value of about 4–7. However, in some applications such conducting plastic mixtures can be used which have a pH value even below 3 or over 8.

The weight ratio of component (A) to component (B) of the electrically conducting complex of the present invention is in the range 90:10 - 30:70 for conventional uses, although in conditions requiring higher conductivity or in acidic conditions, a larger proportion of component (A) may be used. Correspondingly, in compositions or applications requiring strong plasticizing, the electrically conducting complex may contain a larger proportion of component (B). An advantageous weight ratio of component (A) to component (B) is in the range 80:20 - 60:40.

The present invention is also directed to a method of producing an electrically conducting complex, wherein component (A) and component (B) are combined such that limited dissolution will take place at the interface between the components. The limited dissolution is achieved by selection of the raw materials used and the prevailing conditions during the combining of the components. Examples of materials and conditions used in combining the components so as to achieve the invention are given below, however, the process parameters and conditions depend in part upon the specific process equipment used, and other materials and process parameters than those disclosed below would be apparent to those skilled in the art in view of the description below.

For instance, when component (A) contains a conductive polyaniline and component (B) is a zinc compound, partial solubility is detected as a change of color of particles or regions of component (B) (e.g., to a green color) after the materials have been mixed. This is detectable under an optical microscope. When the components have completely dissolved, separate particles or regions are not observable under an optical microscope. If no dissolution has taken place at all, then no change of color of component (B) is detected.

The simplest method of combining components (A) and (B) comprises mixing them together in a mixing device generally used in the plastic industry, and by subjecting the mixture to the action of various agitators, kneaders etc. In an advantageous embodiment, mixing is carried out by using a screw mixer. However, the particular type of mixer is not critical, so long as the mixing power used is sufficient to bring about mixing of the various parts of the electrically conducting complex, but the mixing must not lead to a completely homogeneous mixture, where components (A) and (B) have dissolved entirely.

Combining the components of the electrically conducting complex is advantageously performed at a temperature between about 100° and 200° C., preferably at a temperature between about 130° and 170° C. However, other temperatures outside of these ranges may also be used.

Solidification of the polymer complex is advantageously performed, for example, by running the mixture through a screw mixer in one or several heating cycles, whereby the temperatures are approximately 50°–400° C., preferably 80°–300° C., and most preferably 100°– 200° C. In terms of technical procedure, the solidification procedure used is analogous to the one presented in U.S. Pat. Nos. 5,346,649 and 5,340,499, which are incorporated herein by reference.

The present invention is also directed to a conducting plastic of high electrical conductivity, comprising the electrically conducting complex of components (A) and (B), as discussed above, and a polymer matrix.

In a preferred embodiment of the invention, the electrically conducting complex of the present invention is mixed with an insulating polymer matrix material, thereby obtaining an electrically conducting plastic compound. The matrix material can be a thermosetting resin, a thermoplastic resin or an elastomeric polymer, but must be compatible with the electrically conducting complex. Preferably the matrix material is melt-processable in the same temperature ranges as the electrically conducting complex itself. An advantageous matrix polymer is a thermoplastic homo- or copolymer based on olefins, styrene, vinyl polymers or acrylic polymers or mixtures thereof, or a thermoplastic condensation polymer. Examples of matrix polymers generally used include polyethylenes, polypropylene, PVC, styrenebutadiene, polyesters, polyamides, ABS (acrylonitrile-butadiene-styrene) and polycarbonates.

Both technically and economically, it is advantageous to obtain a proportion of electrically conducting complex in the plastic blend that is as small as possible. From an economic standpoint, the electrically conducting complex is expensive. From a technical standpoint, the resulting plastic blend will have better mechanical properties with a share of electrically conducting complex in the blend that is as small as possible. The share of electrically conducting complex in the plastic blend may be in the range 1–50% by weight, advantageously 1–25% by weight, and preferably 5–15% by weight, based upon the weight of the resulting plastic blend. With regard to the plastic blends of electrically conducting complex and matrix materials, reference is made to the above-mentioned U.S. Pat. No. 5,340,499.

The ingredients of the electrically conducting plastic can be mixed together with the aid of different mixers, kneaders etc. In one advantageous embodiment, mixing is performed with the aid of a screw mixer.

The present invention is also directed to the use of an electrically conducting complex in plastic materials having a high electrical conductivity.

The following examples describe in greater detail the production and properties of electrically conducting complexes and conducting plastic materials in accordance with the present invention. However, these examples are not intended to limit the scope of the invention in any way.

MATERIALS USED AND CONDITIONS EMPLOYED IN THE EXAMPLES

An emeraldine base form of polyaniline (PANI) produced according to the method presented in the publication Y. Cao, A. Andreatta, A. J. Heeger & P. Smith, Polymer, 30(1989), 2305 was used as the conducting polymer in the tests below. In a deviation from this method, sulphuric acid was used in the polymerization, instead of hydrochloric acid.

SULFOSOFT, a commercial brand of dodecylbenzene sulfonic acid (DBSA), was used as the agent (counter-ion) for doping the polyaniline.

The PANI/DBSA complex used in the tests contains PANI and DBSA in a weight ratio of 1:4. A solidification screw was used to combine and solidify the following ingredients to produce the basic complex I:

| | |
|---|---|
| polyaniline EB | 8.6 wt. % |
| DBSA (SULFOSOFT) | 81.7 wt. % |
| ZnO | 8.5 wt. % |
| $CaCO_3$ | 1.2 wt. % |

A modified injection molding machine as described in patent FI-89775 was used to combine the ingredients and to produce the electrically conducting complex. The operating temperature of the machine was 150° C. and the rotational speed of the screw was 50 rpm during the combining of the ingredients and formation of the complex.

The device described in the foregoing was used to mix together the electrically conducting complex and the matrix polymer. As matrix polymers were used SEBS (styrene-ethylene-butylene-styrene copolymer; KRATON G1651) and HDPE (high density polyethylene; NCPE 3415). Mixing of the SEBS mixture was conducted at a temperature of 170° C., and at a rotational speed of 50 rpm, in 3 cycles. Mixing of the HDPE mixture was conducted at a temperature of 150° C., and at a rotational speed of 50 rpm, in 3 cycles.

EXAMPLE 1

An electrically conducting complex according to the invention was produced by combining a PANI/DBSA complex as component (A) and a basic complex I as component (B) at a weight ratio of 60:40. The resulting complex was then mixed with 30% SEBS, which resulted in a plastic material with a conductivity of 1.9 S/cm. The complex had a pH of <3.

EXAMPLE 2

The procedure described in Example 1 was followed, except that component (B) was a mixture made of zinc oxide and dodecylbenzene sulfonic acid at a molar ratio of 1:2. Component (A) and component (B) were combined at a weight ratio of 77.5:22.5, whereupon the complex was combined with SEBS. The conductivity of the obtained material is 5.0 S/cm and its pH <3.

EXAMPLE 3

The PANI/DBSA complex (component (A)) and the basic complex I (component (B)) were mixed together in the ratios shown in Table 1, and were then mixed with SEBS (30% complex). The electrical conductivities of the plastic material thus obtained are shown in the following Table 1.

TABLE 1

| Share of PANI/DBSA complex in total complex | Conductivity in S/cm |
|---|---|
| 0 | 0.015 |
| 0.2 | 0.15 |
| 0.4 | 0.35 |
| 0.6 | 2.0 |
| 0.8 | 1.7 |
| 1.0 | 0.3 |

Table 1 shows clearly that electrical conductivity is at its best when the weight ratio of the PANI/DBSA complex (component (A) and the basic complex I (component (B)) is in the range 50:50 to 80:20, with a maximum weight ratio of 60:40.

EXAMPLE 4

A mixture of HDPE with an electrically conducting complex having the same content of component (A) and component (B) as in Example 2 was produced. The conductivity of this HDPE mixture is 0.44 S/cm.

EXAMPLE 5

The procedure used in Example 2 was followed, except that 20% of component (B) was replaced by $CaCO_3$. The ratio of component (A) and component (B) in the electrically conducting complex was 65:35. The conductivity of the resulting product was 1 S/cm and the pH was 6.3.

The following comparative examples illustrate the unexpectedly high electrical conductivities of the electrically conducting complex in accordance with the present invention and of the conductive plastic materials containing the electrically conducting complex of the present invention compared with such plastic materials which do not contain either component of the electrically conducting complex, or which have only one component (i.e., component (A) or component (B)) of the complex, or which contain other conductive polymers.

COMPARATIVE EXAMPLE 1

30% of pure PANI/DBSA conductive polymer complex was mixed with SEBS. The electrical conductivity of the obtained SEBS mixture was 0.30 S/cm.

COMPARATIVE EXAMPLE 2

30% of pure basic complex I was mixed with SEBS. The electrical conductivity of the obtained SEBS mixture was 0.015 S/cm.

COMPARATIVE EXAMPLE 3

Polyaniline, ZnO, dodecylbenzene sulfonic acid and $CaCO_3$ quantities according to the formulation described in Example 1 were mixed in the above-mentioned device at 150° C. and with a speed of rotation of 50 rpm to form a complex that was as homogeneous as possible. The obtained electrically conducting complex was mixed with SEBS (30:70), as in Example 1. The measured conductivity of the mixture was 0.070 S/cm.

COMPARATIVE EXAMPLE 4

30% of pure PANI/DBSA electrically conductive complex was mixed with HDPE. The electrical conductivity of the obtained HDPE mixture is 0.0027 S/cm.

COMPARATIVE EXAMPLE 5

VERSICON™, a commercial grade of polyaniline doped with p-toluene sulphonic acid, was mixed at a ratio of 30:70 with SEBS as the matrix plastic. The conductivity of the obtained mixture was only $3.8\times10^{-5}$ S/cm.

COMPARATIVE EXAMPLE 6

The procedure used in Comparative Example 5 was repeated using the method according to the present invention. A electrically conducting complex was produced of VERSICON™ and of the basic complex I at a weight ratio of 40:60. The complex was mixed into the matrix plastic at a ratio of 30:70 using SEBS as the matrix plastic. The conductivity of the plastic material thus obtained was 0.083 S/cm.

The following Table 2 shows a summary of the electrical conductivities of the plastic materials in the foregoing Examples and Comparative Examples.

TABLE 2

| Example | Wt. Ratio A | Wt. Ratio B | Polymer matrix | Conductivity, S/cm |
|---|---|---|---|---|
| 1 | 60 | 40 | SEBS | 1.9 |
| 2 | 77.5 | 22.5 | SEBS | 5.0 |
| 3* | 60 | 40 | SEBS | 2.0 |
| 4 | 77.5 | –22.5 | HDPE | 0.44 |
| 5 | 65 | 35 | SEBS | 1 |
| Comp. 1 | 100 | — | SEBS | 0.30 |
| Comp. 2 | — | 100 | SEBS | 0.15 |
| Comp. 3 | — | — | SEBS | 0.070 |
| Comp. 4 | 1 | — | HDPE | 0.0027 |
| Comp. 5 | 100** | — | SEBS | $3.8*10^{-5}$ |
| Comp. 6 | 40** | 60 | SEBS | 0.083 |

*indicates that the best result obtained in Example 3 was used.
**indicates VERSICON ®

Table 2 clearly shows that when using a complex in accordance with the present invention, where total dissolution of component (A) and component (B) is avoided, a much higher electrical conductivity is obtained in the plastic material.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrically conducting complex, comprising:

(A) a first component comprising a conductive polymer comprising a polyaniline doped with a functionalized protonic acid, and (B) a second component comprising a material capable of dissolving and plasticizing said first component (A), comprising (1) a polyaniline doped with a functionalized protonic acid, and (2) a reaction product of a plasticizing protonic acid and a metal compound, wherein limited dissolution occurs at an interface between component (A) and component (B).

2. The electrically conducting complex according to claim 1, wherein said polyaniline doped with a functionalized protonic acid is a polyaniline doped with dodecylbenzene sulfonic acid (PANI-DBSA).

3. The electrically conducting complex according to claim 1, wherein said second component (B) is less conductive and more plasticizable than said polyaniline in said first component (A).

4. The electrically conducting complex according to claim 3, wherein said polyaniline of component (B) is the same polyaniline as in said component (A), but which has been plasticized.

5. The electrically conducting complex according to claim 1, wherein component (B) comprises (1) a polyaniline doped with dodecylbenzene sulfonic acid, and (2) a reaction product of dodecylbenzene sulfonic acid and a zinc compound.

6. The electrically conducting complex according to claim 1, wherein the reaction product of component (B) comprises a reaction product of dodecylbenzene sulfonic acid and a zinc compound.

7. The electrically conducting complex according to claim 1, wherein component (B) further comprises a calcium compound.

8. The electrically conducting complex according to claim 7, wherein said calcium compound is calcium carbonate.

9. The electrically conducting complex according to claim 6, wherein component (B) further comprises a calcium compound.

10. The electrically conducting complex according to claim 9, wherein said calcium compound is calcium carbonate.

11. The electrically conducting complex according to claim 1, wherein the weight ratio of component (A) to component (B) is in the range 90:10 - 30:70.

12. The electrically conducting complex according to claim 11, wherein said weight ratio is in the range 80:20 - 60:40.

13. A method of producing the electrically conducting complex of claim 1, comprising contacting (A) a first component comprising a conductive polymer comprising a polyaniline doped with a functionalized protonic acid, with (B) a second component comprising a material capable of dissolving and plasticizing said first component (A comprising (1) a polyaniline doped with a functionalized protonic acid, and (2) a reaction product of a plasticizing protonic acid and a metal compound, in such a way that limited dissolution takes place at the interface between component (A) and component (B).

14. The method according to claim 13, wherein said contacting is performed at a temperature of from 100°–200° C.

15. The method according to claim 14, wherein said temperature is from 130°–170° C.

16. The method according to claim 13, wherein the weight ratio of said component (A) to said component (B) in said combining is in the range of 90:10 - 30:70.

17. The method according to claim 16, wherein said weight ratio is in the range of 80:20 - 60:40.

18. A plastic material having high electrical conductivity, comprising the electrically conducting complex of claim 1 and a polymer matrix.

19. The plastic material having high electrical conductivity according to claim 18, wherein said polymer matrix is a thermoplast.

20. A method of preparing a plastic material having high electrical conductivity, comprising combining the electrically conducting complex according to claim 1 with an insulating polymer matrix material compatible with the electrically conducting complex, and mixing to form a plastic material.

21. The method according to claim 20, further comprising melt processing the plastic material into a workpiece, fiber, or film.

22. The method according to claim 20, further comprising solution processing the plastic material into a workpiece, fiber, or film.

* * * * *